US005087098A

United States Patent [19]

Ishizuka

[11] Patent Number: 5,087,098

[45] Date of Patent: Feb. 11, 1992

[54] LUMBAR SUPPORT DEVICE

[75] Inventor: Takanori Ishizuka, Akishima, Japan

[73] Assignee: Tachi-S Co., Ltd., Tokyo, Japan

[21] Appl. No.: 587,690

[22] Filed: Sep. 25, 1990

[51] Int. Cl.[5] ..... A47C 3/00; A47C 25/00

[52] U.S. Cl. ..... 297/284 C; 297/460

[58] Field of Search ..... 297/284 C, 460, 284 R

[56] References Cited

U.S. PATENT DOCUMENTS 4,296,965 10/1981 Sakurada et al. ..... 297/284
4,623,193 11/1986 Lieker ..... 297/284
4,913,495 4/1990 Nagasaka et al. ..... 297/284

FOREIGN PATENT DOCUMENTS 167229 10/1983 Japan ..... 297/284
170638 10/1983 Japan ..... 297/284
130927 6/1989 Japan .

*Primary Examiner*—James R. Brittain
*Assistant Examiner*—James M. Gardner
*Attorney, Agent, or Firm*—Oldham & Oldham Co.

[57] ABSTRACT

A lumbar support device for use in a vehicle seat, including a brake device for restricting rotation of its drive shaft, a link member, and a lumbar support member. A rotation force from the drive shaft is transformed via the link member to the lumbar support member, which makes simplified the structure of the device.

2 Claims, 2 Drawing Sheets

LUMBAR SUPPORT DEVICE

BACKGROUND OF THE INVENTION

1. Field of the Invention

The present invention relates to a lumbar support device which is provided with a seat of such vehicle as an automobile.

2. Description of Prior Arts

In general, for use in a vehicle seat, especially, for use in a driver's seat of an automotive seat, there is widely available a lumbar suppoert device wherein a pressure is adjustable for supporting the lumbar of an occupant, in order that the occupant may attain a best seating feeling on the seat.

Such lumbar support device is basically constructed such that a lumbar support elements are incorporated within the seat back of a seat and an adjusting actuator mechanism is provided for causing fore-and-aft movement of the lumbar support elements so as to adjust a supporting pressure against the lumbar of the occupant.

Conventionally, according to the hitherto lumbar support device, the adjusting actuator mechanism thereof has been equipped with a non-reversible brake device, such as a window-regulator type friction brake device, where its drive shaft is caused to rotate only through an associated operation spindle, and a rotation of the drive shaft is transmitted to the lumbar support elements via a gear mechanism, which causes displacement of the lumbar support elements, whereby a desired adjustment can be effected for gaining an optimum supporting pressure against the lumbar portion of an occupant sitting on the seat. (as, for example, disclosed in the Japanese Allowed Publication No. Hei 1-30927).

However, the fact that the gear mechanism is installed in the foregoing conventional adjusting actuator mechanism results in the disadvantage that an assemblage involved requires a troublesome step for working intricately into a base frame a gear unit having a complexity of plural gears, which is a time-consuming, annoying aspect and also quite high in costs and number of fittings and parts.

SUMMARY OF THE INVENTION

In view of the above-stated drawbacks, it is therefore a purpose of the present invention to provide an improved lumbar support device which is simplified in structure and easy to be assembled into a seat.

In achievement of such purpose, the present invention comprises a lumbar support means which is pivotally supported at both lateral frame sections of a seat back frame, so that the lumbar support means is free to rotate forwardly and backwardly relative to the seat back frame; a brake means provided fixedly on one of the two lateral frame sections of the seat back frame, the brake means being adapted for restricting rotation of a drive shaft in order that the drive shaft is only permitted to rotate through operation of an operation spindle; and a link means fixed on the drive shaft of the brake means, the link means being at its free end part in an operative engagement with the lumbar support means.

Accordingly, with the above structure, a rotation of the drive shaft by the operation spindle is transmitted to the lumbar support means via the link means, which causes forward and backward rotative motion of the lumbar support means so as to give a desired lumbar support force against the lumbar part of an occupant on the seat in a steplessly adjustable manner. It is appreciated that the use of the link means in the adjustment actuator mechanism of the device leads to a much simplified structure of the same, making far easier the assemblage of the lumbar support device into the seat, at a low costs with a reduced number of parts.

DETAILED DESCRIPTION OF PREFERRED EMBODIMENT OF THE INVENTION

Hereinafter, a specific description will be made of a lumbar support device according to the present invention, with reference to FIGS. 1 through 5.

Figure 1:
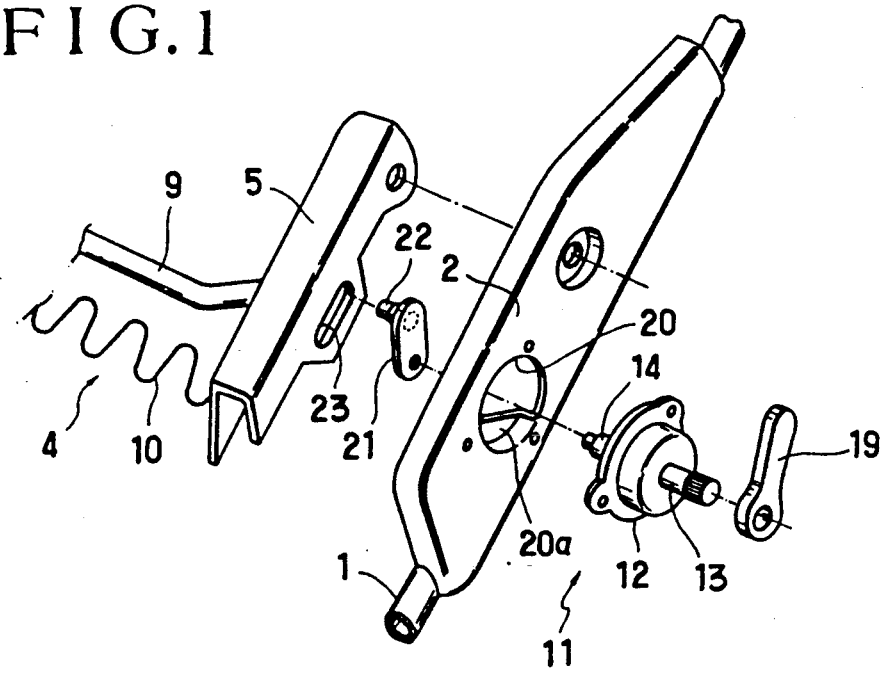
FIG. 1 is a partially exploded perspective view of a principle part of lumbar support device according to the present invention.
Figure 2:
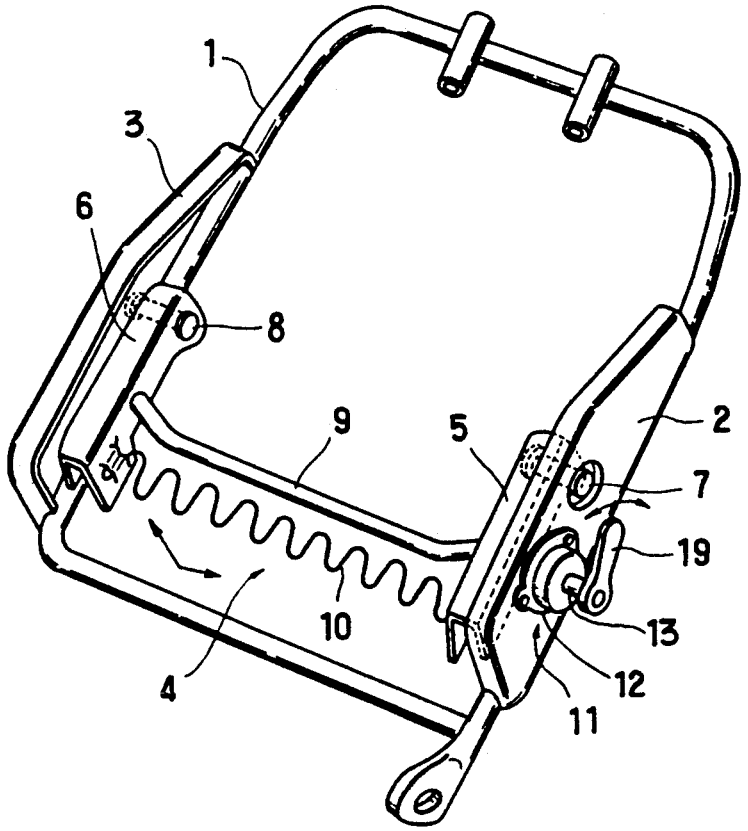
FIG. 2 is a perspective view showing a whole seat back frame provided with the lumbar support device.
Figure 3:
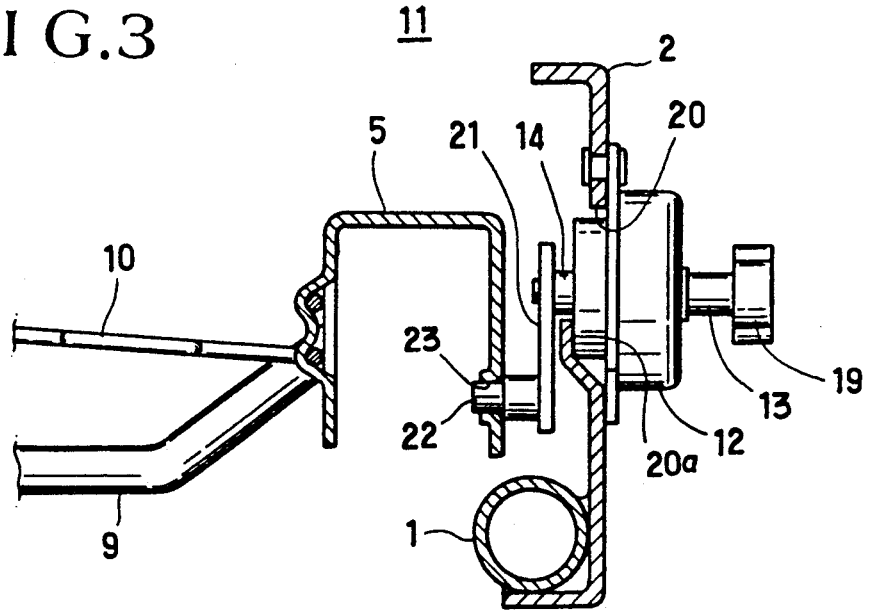
FIG. 3 is a partial cross-sectional view of the principle part of the lumbar support device, as viewed from the below thereof.

Reference is now made to FIGS. 1, 2 and 3, which respectively gives an exploded view of principle part of the present invention, an assembled view of the same wherein the lumbar support device is mounted on a seat back frame (1), an a partial sectional view of that principal part.

Although not shown, the seat back frame (1) is provided within a seat back of an automotive seat. As shown, to both lateral frame sections of the seat back frame (1), are each fixed a pair of side brackets (2)(3), and between the two side brackets (2)(3), is arranged a lumbar support member (4) such that it is disposed at the lower region of those side brackets (2)(3), which corresponds to the lumbar part of an occupant who leans thereagainst, and that the lumbar support member (4) is to be displaced forwardly and backwardly with respect to the seat back frame (1), as will be understandable later.

The lumbar support member (4), in the embodiment shown, comprises a sinusoidal spring (10).

Inwardly of the two side brackets (2)(3), are provided a pair of arms (5)(6) in a manner being rotatable (swingable) forwardly and backwardly relative to the side brackets (2)(3). Specifically, the arms (5)(6) are at their upper end parts, respectively, pivotally, rotatably supported via pivots (7)(8) to the inner surfaces of the side brackets (2)(3), so that the arms (5)(6) are free to rotate about the respective pivot points (7)(8). A connecting rod (9) is at both ends thereof welded to the arms (5)(6), such as to extend therebetween on a horizontal plane centrally thereof, thus connecting the two spaced-apart arms (5)(6) in an integral manner. Preferably, the connecting rod (9) is formed generally in a U-shaped configuration projecting rearwardly of the two arms (5)(6).

The foregoing lumbar support member (4), or the spring (10), underlines the connecting rod (9); in other words, the spring (10) is at its both ends fastened to the respective arms (5)(6), extending therebetween. This structure permits the supportive spring (10) to be displaced forwardly and backwardly relative to the seat back frame (1) by the corresponding forward and backward rotation of the arms (5)(6), whereupon it is to be seen, although not depicted in the drawings, that the fore-and-aft movement of such lumbar support member (10) varies the degree at which a cushiony padding laying upon that support member (10) is pressed forwardly of the seat back, which adjusts a supporting pressure against the lumbar part of an occupant on the seat.

As viewed from FIG. 2, at the side bracket (2) on the right side, there is provided an adjustment actuator mechanism (11) for adjustably displacing the lumbar support member or spring (10) in the forward and backward direction.

According to the adjustment actuator mechanism (11), there is introduced a non-reversible brake device (12) of the type similar to a known friction brake device employed for a wind regulator of an automobile. The brake device (12) is fixed on the lateral surface of the side bracket (2) in a manner being correspondingly associated with the lumbar support spring (10), as will be specifically stated later, the arrangement thereof being briefly such that its operation spindle (13) projects outwardly while its drive shaft (14) projects inwardly, in regard to the body of the device (12), and that a rotation force applied to the drive shaft (14) leads in no way to the rotation of the same shaft (14), but only an operational rotation of the operation spindle (13) permits an integral, synchronized rotation of both operation spindle (13) and drive shaft (14).

Figure 4:
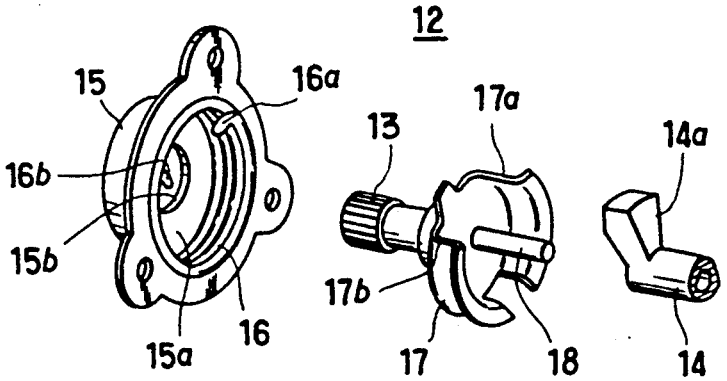
FIG. 4 is an exploded perspective view of a brake device.
Figure 5:
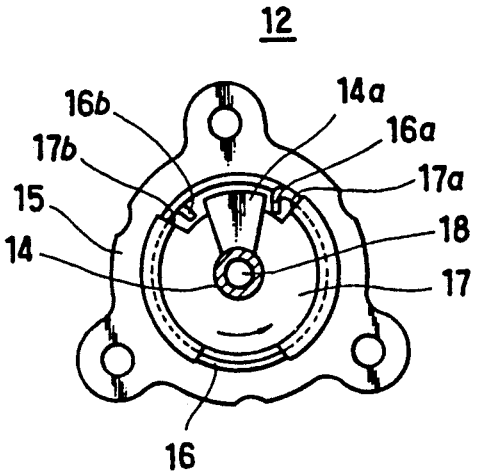
FIG. 5 is a side elevation of the brake device as in the FIG. 4.

Referring to FIGS. 4 and 5, there is shown a specific structure of the above-mentioned brake device (12). According thereto, designations (15) and (17) represents an outer casing having a generally cylindrical configuration and an inner casing of a generally circular shape. The outer casing (15) is formed with a circular cavity (15*a*) therein, in which is received resiliently a coil torsion spring (16) and also with a shaft hole (15*a*). The spring (16) has, formed at the respective both ends, a first engagement bent part (16*a*) and a second engagement bent part (16*b*), and expands outwardly into a close, pressed contact with the inner circumferential surface of the outer casing (15). The inner casing (17) is so formed as to have an outer diameter smaller relatively than the inner diameter of the cavity (15*a*) of the outer casing (15), and define therein a first engagement edge (17*a*) and second engagement edge (17*b*) in a manner to permit the first and second engagement parts (16*a*)(16*b*) of the spring (16) to be brought to engagement with the corresponding first and second edges (17*a*)(17*b*). The operation spindle (13) projects integrally from the outer surface of the inner casing (17), whereas a shaft (18) is fixed to the inner surface thereof, projecting therefrom coaxially of the spindle (13). The inner casing (17) is placed within the circular cavity (15*a*) of the outer casing (15), with the operation spindle (13) passing through the hole (15*a*) of the outer casing (15) and with the spring (16) circumscribing the outer periphery of the inner casing (17).

To the foregoing shaft (18), is rotatably fitted and supported the drive shaft (14) which is thus projected inwardly of the right-side side bracket (2), as can be seen from FIGS. 4 and 1, in such a manner that an integral arm (14*a*) is formed on the drive shaft (14), the arm being normally disposed between the first and second enagement end parts (16*a*) (16*b*) of the spring (16).

With the above-stated structure, if the operation spindle (13) is rotated in the arrow direction in FIG. 5, for instance, then the inner casing (17) is simultaneously rotated together, and the first engagement edge (17*a*) is brought to engagement with the first engagement end part (16*a*) of the spring (16). Then, with further rotation of the operation spindle (13) in the same direction, the coil spring (16) is wound into a contracted state with its diameter being reduced, to thereby be left out of contact with the inner circumferential surface of the outer casing (15), which places the operation spindle (13) in a state being free to rotate in the arrow direction. At this moment, the first engagement edge (17*a*) is brought to abutment against the arm (14*a*) of the drive shaft (14), whereupon the drive shaft (14) is now in an interlocking relation with the operation spindle (13). Thus, by continuing to rotate the spindle (13), the drive shaft (14) is caused to rotate in the same direction.

When ceasing such rotation of the spindle (13) at a given point and releasing it, the coil spring (16) is resiliently expanded, rotating reversely the inner casing (17), into a normal pressing contact with the inner circumferential surface of the outer casing (16) again, so as to prevent rotation of both spindle (13) and drive shaft (14).

As understandable from FIG. 5, the brake device (12) is so arranged that the arm (14*a*) functions to prevent an unexpected rotation force from being imparted to the operation spindle (13); in other words, if an unexpected rotation force is applied to the drive shaft (14), attempting to cause rotation of the spindle (13), the arm (14*a*) integral with the drive shaft (14) is rotated about the shaft (18) into a pressing abutment against either of the engagement end parts (16*a*)(16*b*), thereby pressing it to cause further expansion of the coil (16) to enhance its frictional contact against the inner circumferential surface of the outer casing (15), and thus insuring to block the simultaneous rotation of both drive shaft (14) and spindle (13).

To the free end part of the spindle (13), is fastened an operation handle (19). The drive shaft (14) passes through a hole (20) formed in the right-side bracket (2) and projects inwardly thereof. As best shown in FIG. 1, in the hole (20), there is provided a recessed platform area (20*a*) which is press formed continuously from the side bracket (2), the 20 area (20*a*) occupying a certain space within the hole (20) and being adapted to receive a part of the inner casing (17) of the brake device (12) (see FIG. 3) for allowing for determining a given location of the brake device (12) relative to the side bracket (2)

A link member (21) is at its base end fixed to the free end of the drive shaft (14). The other free end of the link member (21) has, formed thereon, an engagement pin (22) which is inserted through an elongated hole (23) formed at the lateral surface of the arm (5). The elongated hole (23) is formed there along the longitudinal direction of the arm (5), thus extending generally in a vertical direction relative to the seat (not shown), and, within such hole (23), the pin (22) is in a slidable engagement for free movement therealong.

Now, description will be made of an operation for the above-constructed lumbar support device.

When it is desired to increase a pressure support force of the lumbar support spring (10) against the lumbar part of an occupant on the seat, the operation handle (19) is rotated forwardly as indicated in the arrow direction in FIG. 2, which causes simultaneous likewise rotation of both spindle (13) and drive shaft (14) via the foregoing brake device (12), with the result that the link member (21) is caused to rotate in the same forward direction, with the engagement pin (22) being slidingly moved along the elongated hole (23) in its donwnward direction, thereby rotating both two arms (5)(6) relative to their respective rotation centers (7)(8) in a direction forwardly of the seat back frame (1), as indicated by the arrow. Then, the lumbar support member (4) is displaced forwardly in a sense to give an increased pressure against the occupant's lumbar part through a seat back padding which is not shown. Here, to release the operation handle (19) will actuate the brake device (12) to prevent the spindle (13) and shaft (14) against any further rotation, so that the occupant may stop the forwardly pressing motion of the lumbar support member (4) or the spring (10) to set a desired degree of lumbar supporting force against his or her lumbar part. For decreasing the lumbar support force, the steps stated above should be effected in a reverse manner, by rotating the handle (19) in a backward direction, as opposed to the foregoing forward rotation, which will be easily understood and thus a specific description thereon is deleted.

From the description above, it is to be appreciated that the lumbar support device according to the present invention is endowed with the following various meritorious effects:

(1) Simple rotational operation of the handle (19) permits a stepless fine adjustment of the lumbar support member (4) to attain a desired lumbar support pressure against the lumbar part of an occupant in accordance with his or her tastes.

(2) The link member (2) is employed as a means for transmitting the rotation force of the drive shaft (14) to the lumbar support member (4). Thus, the lumbar support device is much simplified structurally in comparison with the conventional one which uses a intricate gear mechanism. In assemblage, to mount the adjustment actuator mechanism (11) in the device, the brake device (12) is secured to the side bracket (2), while at the same time, the engagement pin (22) of the link member (21), which has previously been fixed to the drive shaft (14), is merely engaged in the elongated hole (23) of the arm (5), hence making quite easier steps of assembling process.

(3) With the above constituent elements, a number of required parts is greatly reduced, which contributes to keeping the costs in a lower level and provides a low-cost production of the device.

(4) The link member (21) can be freely designed in order that its length may be shortened or lengthened as desired. Therefore, the brake device (12) can be located at a desired point in relation to the link member (21), which means to allow free designability of a main actuating element, depending on a seating situation around an associated seat, and also has an advantage in enabling free location of the operation portion of the lumbar support device at a desired point which is readily accessible to an occupant sitting on the seat.

While having described the invention as above, it should be understood that it is not limited to the illustrated embodiment, but any other modification, replacement, and addition may structurally be possible without departing from the spirit and scopes of the appended claims.

What is claimed is:

1. A lumbar support device, comprising:

a seat back frame having a pair of lateral frame sections;

a pair of side brackets each fixedly provided on the respective said lateral frame sections;

a pair of arms each pivotally connected to the respective said two side brackets, such that said arms are disposed inwardly of said side brackets and their respective rotation centers are located at their upper end parts relative to the corresponding said two side brackets, so that said two arms are free to rotate about said rotation centers in a fore-and-aft direction with respect to said seat back frame;

a lumbar support means extending between said arms, so that said lumbar support means is free to rotate forwardly and backwardly relative to said seat back frame as said arms rotate;

a connecting rod extending between said arms;

a brake means provided fixedly on one of said two lateral frame sections on said seat back frame, said brake means being adapted for restricting rotation of a drive shaft in order that said drive shaft is only permitted to rotate through operation of an operation spindle; and a link means fixed on said driven shaft of said brake means, said link means being at its free end part in an operative engagement with said lumbar support means, said link means including an engagement pin provided at its end part, wherein said engagement pin is in an slidable engagement with an elongated hole which is formed in one of said arms, whereby rotation of said drive shaft causes a lumbar support action of said lumbar support means via said link means.

2. The lumbar support device according to claim 1, wherein said lumbar support means comprises a sinusoidal spring.

* * * * *